United States Patent [19]

Ishiwatari et al.

[11] Patent Number: 4,641,690

[45] Date of Patent: Feb. 10, 1987

[54] METHOD AND APPARATUS FOR PREVENTING STRATIFICATION OF LIQUEFIED GASES IN A STORAGE TANK

[75] Inventors: Takeo Ishiwatari, Chiba; Yasuchiyo Sasaki, Narita; Rokuro Misawa; Shingo Takao, both of Yokohama, all of Japan

[73] Assignee: Nippon Kokan Kabushiki Kaisha, Tokyo, Japan

[21] Appl. No.: 733,408

[22] Filed: May 13, 1985

Related U.S. Application Data

[63] Continuation of Ser. No. 329,326, Dec. 10, 1981, abandoned.

[51] Int. Cl.[3] ..... B65B 3/04

[52] U.S. Cl. ..... 141/4; 141/9; 141/113; 141/285; 141/392

[58] Field of Search ..... 141/1, 113, 285, 286, 141/311 R, 367, 374, 392, 4, 5, 255, 264; 261/122; 220/85, 86

[56] References Cited

U.S. PATENT DOCUMENTS 3,946,758 3/1976 Hansel ..... 141/374

OTHER PUBLICATIONS

American Society of Mechanical Engineers (ASME Paper No. 83-WA/HT-77), New York, N.Y., Nov. 1983, The Formation of a Non-Linear Density Gradient.

*Primary Examiner*—Houston S. Bell, Jr.

*Attorney, Agent, or Firm*—Fleit, Jacobson, Cohn & Price

[57] ABSTRACT

Disclosed is a technique whereby when multi-component liquefied gases such as liquefied natural gases (LNG), liquefied petroleum gases (LPG) or the like which are different in composition, density or the like are stored in the same storage tank, any stratification of the liquefied gases within the storage tank is prevented.

The introduction of the liquefied gas into the storage tank is accomplished in such a manner that the introduced gas enters the storage tank in the form of a jet of liquefied gas which is shoot out from near the tank bottom obliquely upwardly with an ascending vertical angle in a predetermined range and reaches or comes near to the free surface within the storage tank, and in this way the desired mixing of the introduced liquefied gas with the liquefied gas previously existing in the storage tank is effected as soon as the introduced liquefied gas enters the tank.

8 Claims, 13 Drawing Figures

METHOD AND APPARATUS FOR PREVENTING STRATIFICATION OF LIQUEFIED GASES IN A STORAGE TANK

This application is a continuation of application Ser. No. 329,326, filed Dec. 10, 1981, now abandoned.

BACKGROUND OF THE INVENTION

The present invention relates to a method for preventing any stratification of the liquefied gases within a storage tank, and more particularly the present invention relates to improvements in and relating to a method and apparatus for introducing liquefied gas into a storage tank whereby when the multi-component liquefied gases comprising different kinds of liquefied gas such as liquefied natural gas (LNG) or liquefied petroleum gas (LPG) are stored in the same storage tank, the liquefied gas already existing in the storage tank and the newly introduced liquefied gas are prevented from being formed into separate strata within the storage tank due to differences in composition, density, temperature or the like.

With a multi-component liquefied gas, e.g., LNG, it is well known in the art that the gases of different origins differ in composition and density from one another and the same applies to those from the same origin but extracted on different days. When such a multi-component liquefied gas is introduced into a storage tank from a transport ship or the like, while there will be no problem if the storage tank is filled with the gases of the same composition (those of the same origin and the same extraction date), if the remaining quantity of the previously introduced gas is small so that the storage tank has a space in surplus and thus a new supply of liquefied gas of a different composition or temperature is introduced into the storage tank, the heavy and light gases do not mix together due to differences in density and these gases are formed into vertically separated strata. The formation of these strata may sometimes cause a dangerous phenomenon which is known as a roll over phenomenon.

The roll over phenomenon is one in which when multi-component liquefied gases which are different in composition and hence in density are contained in the same storage tank as mentioned previously, a stratum of higher density gas and a stratum of lower density gas will be formed as vertically separate strata; in the case of for example LNG liquefied at a very low temperature of −162° C., naturally there is a heat input through the outer walls of the storage tank so that due to the nature of the boundary surface of the vertically formed two strata that it is stable and its amount of heat transfer is small, the heat is accumulated in the lower stratum of the lower density liquefied gas and the thus accumulated heat energy is rapidly dispersed in the form of evaporation of a large quantity of the liquid. As a result, there is the danger of the inner pressure exceeding the control range of the storage tank inner pressure and becoming higher than the designed limit pressure.

The density of LNG differs depending on the place of origin, that is, the density of LNG from Alaska is 424 $Kg/m^3$, that of LNG from Brunei is 473 $Kg/m^3$ and so on. If such LNGs having different densities are introduced into the same storage tank, a vertical stratification will be caused by the differences in density and the above-mentioned roll over phenomenon may sometimes be caused. Thus, the usual practice to prevent this phenomenon has been such that LNG of different origins are stored in separate storage tanks and thus even the amount of the stored gas is as small as about one fifth of its holding capacity thus leaving a sufficient space in surplus, any LNG having a different composition and hence a different density will never be introduced into the storage tank. In other words, if the previously introduced liquefied gas is in excess of about 1/5 of the holding capacity of the storage tank, any other LNG having a different composition is not introduced into the storage tank and the remaining space is left unused. While this prevents the occurrence of any roll over phenomenon, the present situation is such that the number of storage tanks installed at a harbor or along the coast is in excess of the required number exceeding the actual holding capacity so that not only a vast plot of ground is required but also the cost amounts to a huge sum due to the installation of refrigerating equipment for maintenance of the facilities.

Under these circumstances, as an anti-stratification measure, an attempt has heretofore been made such that when the amount of LNG contained in a storage tank is considerably less than its holding capacity, a filling nozzle is introduced into the LNG and LNG of a different composition is introduced to stir up and mix the two. The conventional filling nozzle used in this attempt has not been designed in consideration of mixing the liquefied gases having large differences in density and thus the jet of gas issued from the nozzle has failed to reach the free surface of the LNG within the storage tank thus making it impossible to stir up and mix the LNGs having large differences in density.

SUMMARY OF THE INVENTION

The present invention has been created to overcome the foregoing deficiencies in the prior art and it is the primary object of the present invention to prevent any stratification of multi-component system liquefied gases such as LNG or LPG within a storage tank due to differences in composition and also to prevent the occurrence of a roll over phenomenon.

In accordance with one form of the present invention, the introduction of a multi-composition system liquefied gas into a storage tank is effected in such a manner that a jet stream of the introduced liquefied gas issues from near the tank bottom obliquely upwardly with a predetermined angle of elevation within the storage tank and reaches or comes near to the free surface. The angle of elevation or the issuing angle can be defined as an angle $\theta$ made by the jet stream axis with the horizontal plane and this issuing angle is selected within a range of $60° < \theta < 90°$ as will be described later.

In accordance with another form of the invention, the liquefied gas is introduced into the storage tank in the form of the obliquely upward jet of liquefied gas as a main jet and an additional secondary jet of liquefied gas in a relatively small quantity which is directed toward the tank bottom area from an issuing point lower than the main jet issuing point. The method involving the secondary jet of liquefied gas can be advantageously used particularly in cases where a newly introduced and issued liquefied gas is lower in density than the liquefied gas already existing in the storage tank. In this case, the issuing angle $\theta$ of the main jet of liquefied gas is selected within a range $60° < \theta < 80°$.

In accordance with one form of a filling apparatus according to the invention, a filling nozzle arranged inside a storage tank to create the obliquely upward jet of liquefied gas is hung down into the storage tank such that the nozzle injection axis is directed obliquely upward and this ascending vertical angle provides the previously mentioned issuing angle $\theta$.

In accordance with another form of the apparatus, the filling nozzle hung down into the storage tank to create the obliquely upward jet of liquefied gas includes a main nozzle whose angle $\theta$ of injection from its nozzle tip forms an elevation angle in the range of $60° < \theta < 90°$ and an auxiliary nozzle which is communicated with the main nozzle to direct a jet of liquefied gas of a relatively small quantity into the tank bottom area.

In accordance with the method of this invention, with a storage tank for storing mult-component system liquefied gas such as LNG or LPG, liquefied gases of different densities can be introduced and issued into the tank. In this case, a filling nozzle having a predetermined injection or issuing angle in accordance with the invention is used and hung down into the liquefied gas previously stored in the storage tank so that a new supply of liquefied gas is introduced and issued into the storage tank through the filling nozzle. This has the effect of stirring up and mixing the fresh supply of liquefied gas issued from the filling nozzle and the previously stored liquefied gas at the time of the filling, with the result that the prevention of stratification is ensured even in the case of the multi-component system liquefied gases having large differences in density and the occurrence of the roll over phenomenon is prevented.

Further, while, in the past, the introduction of any replenishing supply of liquefied gas of a different composition is avoided in order to prevent the occurrence of stratification and roll over phenomenon even if a storage tank has a surplus space, in accordance with the method of this invention the introduction of a new supply of liquefied gas having a different density is possible for replenishing purposes. Thus, the storage tank can be filled with such liquefied gases up to its holding capacity and effective utilization of the storage tank is ensured. Therefore, the present invention greatly contributes industrially.

More specific embodiments of the invention, together with its functions and effects, will be readily understood from the detailed description taken in conjunction with the accompanying drawings.

DESCRIPTION OF THE PREFERRED EMBODIMENTS

Prior to a detailed description of the invention, the prior art will be described briefly with reference to FIGS. 1 and 2.

Figure 1A:
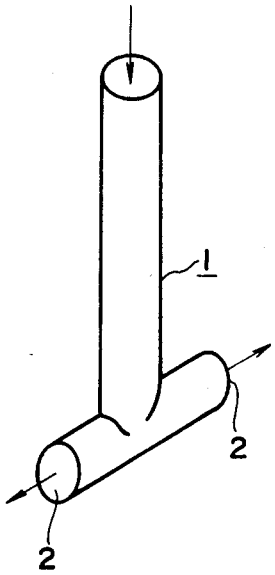
FIGS. 1*a* and 1*b* are schematic views of conventional filling nozzles.
Figure 1B:
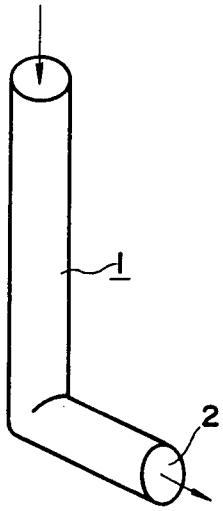
Figure 2:
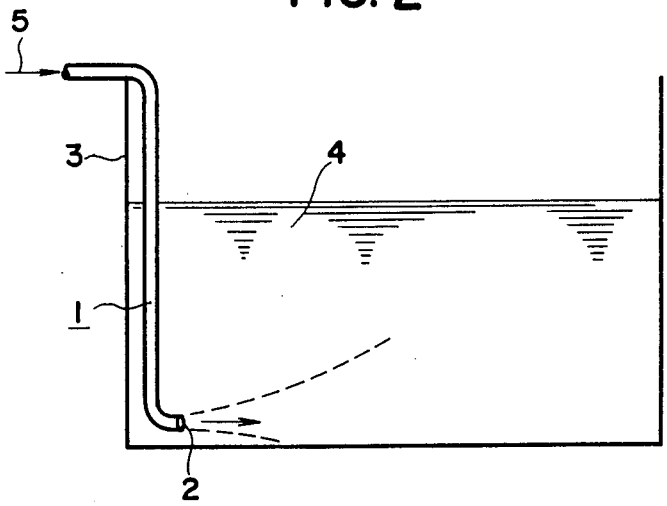
FIG. 2 is a schematic diagram showing the manner in which a jet of gas is issued from the filling nozzle of FIG. 1*b*.

In FIGS. 1*a* and 1*b* showing conventional filling nozzles, numeral 1 designates a filling nozzle and numeral 2 designates the issuing direction or the axis of injection from each nozzle tip. FIG. 2 shows by the dotted lines the behavior of the jet of gas resulting when a second LNG 5 of a different composition is introduced through the filling nozzle of FIG. 1*b* which is hung down into a storage tank 3 storing a first LNG 4 which was introduced preliminarily. As will be seen from FIG. 2, due to the issuing angle of the conventional filling nozzle being directed in a horizontal direction parallel to the bottom surface of the storage tank 3, while the gases may be stirred up and mixed together in cases where the initial depth of the first LNG 4 is small or the density difference of the introduced second LNG 5 is relatively small, the jet of gas issued from the nozzle tip 2 cannot reach or come near to the free surface of the previously stored first LNG 4 if the initial depth is large or the density difference is large. Thus, in such a case, when the second LNG is introduced into the storage tank, the stirring and mixing of the upper and lower gases cannot be effected satisfactorily and the formation of strata is still unavoidable.

Figure 3:
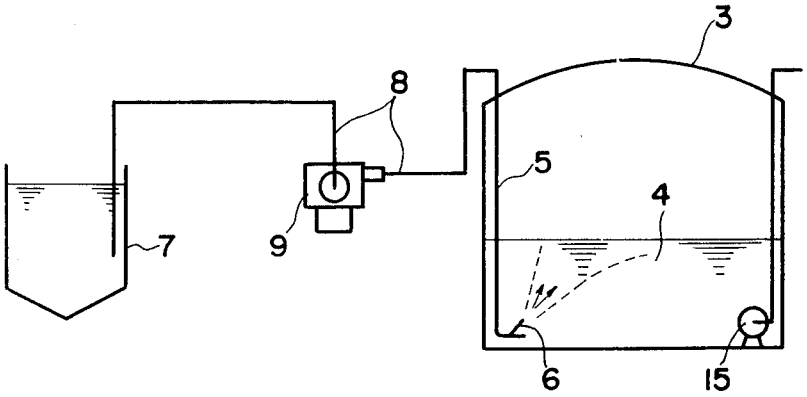
FIG. 3 is a basic flow diagram showing the use of a filling nozzle according to the present invention.

FIG. 3 shows a flow diagram for explaining a basic example of the method according to the invention, in which LNG is introduced into a storage tank 3 from an LNG transport ship 7 via a filling line pipe 8. More specifically, a filling nozzle 6 is hung down into the preliminarily stored LNG 4 in the storage tank 3 and LNG 5 having a different density is introduced into the storage tank 3 via the filling nozzle 6. In this case, from the standpoint of improving the effect of this invention it is desirable to arrange a pressure pump 9 in the line pipe 8 so as to increase the feeding rate of the LNG 5. Numeral 15 designates a submerged pump for delivering the gas to the outside of the storage tank 3.

Figure 4:
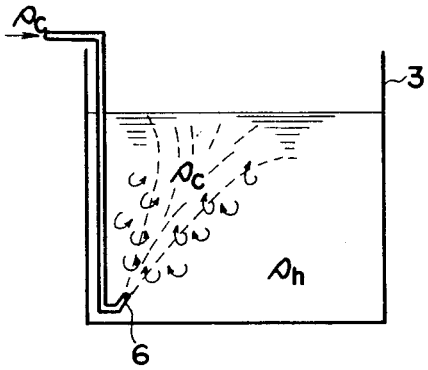
FIG. 4 is a diagram showing the flow conditions of the liquefied gases within a storage tank into which the liquefied gas having a different density is issued in accordance with the invention.
Figure 5A:
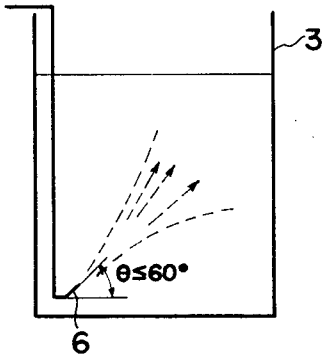
FIG. 5 is a diagram showing the flow condition of the liquefied gas in a case where the issuing angle $\theta < 60°$.
FIG. 5*b* is a diagram showing the flow condition of the liquefied gas in another case where the issuing angle $\theta < 60°$.

The principle of preventing stratification of the multi-component system liquefied gases in a storage tank in accordance with the invention will now be described. Where the storage tank already contains a first multi-component liquefied gas such as LNG in an amount corresponding to about 1/5 to $\frac{2}{3}$ of its holding capacity and thus there is still a surplus space, if a second LNG which is different in composition or density from the first LNG within the storage tank is introduced into the tank, that is, if the density $\rho_c$ of the second liquefied gas is different from the density $\rho_h$ of the first liquefied gas which was previously stored in the storage tank, as shown in FIG. 4, the second liquefied gas of the density $\rho_c$ swallows up the first liquefied gas of the density $\rho_h$ so that the first and the second liquefied gases are stirred up and mixed during the introduction. If the injection angle $\theta$ of the filling nozzle 6 is less than 60°, as shown in FIG. 5*a*, the angle of jet is too small so that the resulting jet of gas may fail to reach or come near to the free surface or the jet of gas may strike against the side walls of the storage tank with the resulting deterioration of the swallow-up, thus deteriorating the effect of the nozzle. In other words, if the issuing angle is not proper, there is the disadvantage of causing a density distribution in the following manner.

Figure 6:
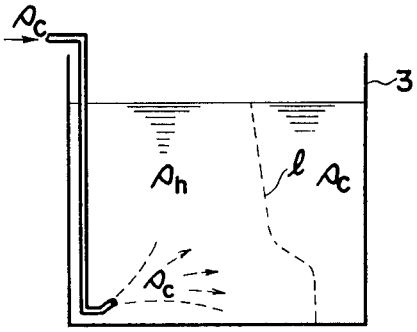
FIG. 6 is a diagram for explaining the formation of strata due to the differences in density of the gases.

For instance, where the densities $\rho_c$ and $\rho_h$ are $\rho_c<\rho_h$ and the initial depth of the first liquefied gas with the higher density $\rho_h$ is relatively small, if the issuing angle $\theta$ of the second liquefied gas with the density $\rho_c$ has an elevation angle of less than 60°, the jet stream of the second liquefied gas decreases its flow velocity in the first liquefied gas and thus the second liquefied gas is partially distributed within the storage tank without sufficiently swallowing up the first liquefied gas. As a result, the gases are stored in such a manner that the lighter second liquefied gas floats to the surface and the introduction and filling of the second liquefied gas is completed without the second liquefied gas being sufficiently mixed with the heavier first liquefied gas as shown in FIG. 6 upon completion of the introduction. Thus, the densities $\rho_c$ and $\rho_h$ result in the formation of a density distribution l and this results in the formation of strata.

Figure 5B:
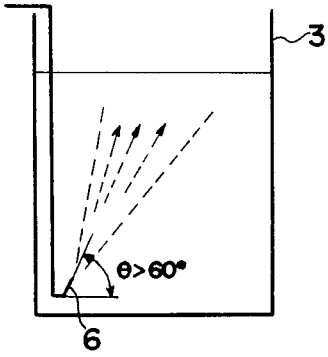
Figure 7A:
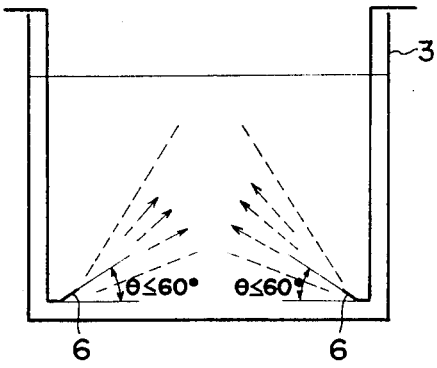
FIG. 7*a* is a diagram similar to FIG. 5*a* but using two of the filling nozzle of FIG. 5*a*.
Figure 7B:
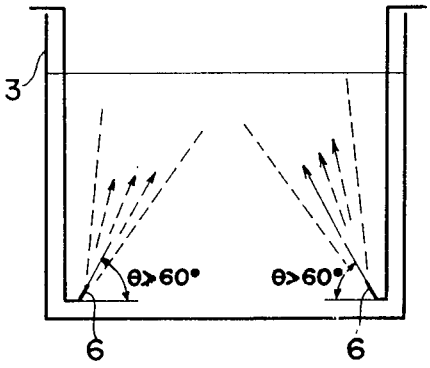
FIG. 7*b* is a diagram similar to FIG. 5*b* but using two of the filling nozzle of FIG. 5*b*.
Figure 8:
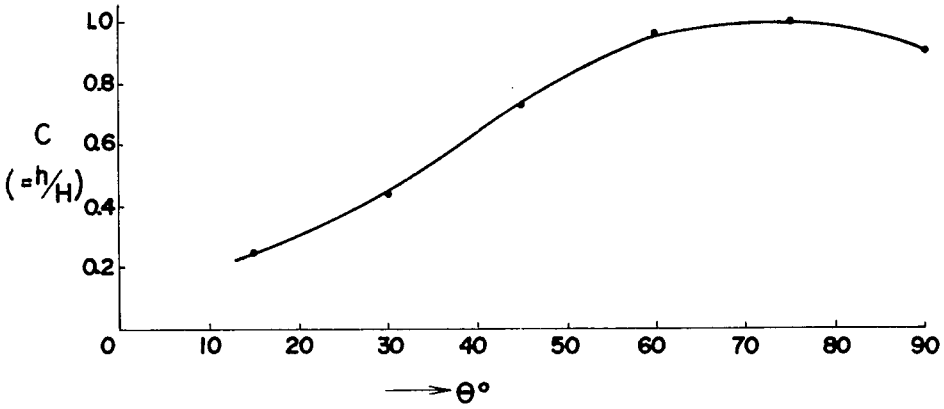
FIG. 8 is a graph showing the relation between the issuing angle of the filling nozzle and the height of jet stream.

In accordance with the present invention, the issuing angle from the nozzle tip of the filling nozzle is selected $60°<\theta$, and FIG. 5*b* shows the manner of mixing resulting from the use of the filling nozzle in accordance with this intention of the invention. It is also shown that where a plurality of the filling nozzles are used as in the cases of FIGS. 7*a* and 7*b*, if the issuing angle is $\theta<60°$ as in the cases of FIGS. 5*a* and 5*b*, the resulting mixing effect is insufficient and that an excellent mixing effect is ensured with the intended issuing angle of $60°<\theta$ in accordance with the invention.

Where a first liquid having a uniform density is contained in a storage tank and a second liquid having a higher density is issued into the first liquid upwardly with an angle $\theta$, the resulting issuing height h is determined in accordance with the nozzle jet diameter, the density difference and the flow rate with the angle $\theta$ as a parameter. As a result, the height h can be said to be directly proportional to a quantity H having a unit of length and determined in accordance with three physical quantities including the nozzle jet diameter, the density difference and the flow rate and it has been confirmed experimentally by the inventors, etc., that its proportionality constant C varies with the angle $\theta$ as shown in FIG. 8. It will be seen from the experimental results in FIG. 8 that the rate of rise in the height of jet increases with increase in the angle $\theta$ when the angle $\theta$ is in the range from 0° to 60°, that the rate of rise remains substantially constant when the angle $\theta$ is in the range from over 60° to 80° and that the rate of rise decreases when the angle $\theta$ reaches 90°. Thus, the most desirable range of $\theta$ is from over 60° to 80° and the effect of the nozzle deteriorates when the angle $\theta$ reaches 90°. Thus, in order to achieve the desired effect of the invention it is necessary that the angle $\theta$ is in the range of $60°<\theta<90°$. This can be conceived to be attributable to the fact that the efficiency of mixing in the vertical direction increases with increase in the height of jet of gas.

Figure 9:
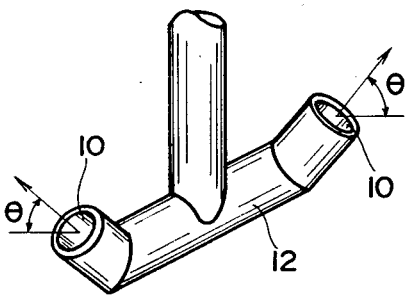
FIGS. 9 and 10 are schematic perspective views showing preferred forms of the filling nozzle used with the present invention.
Figure 10:
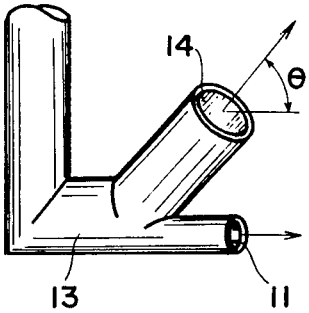

FIG. 9 is a schematic perspective view of a filling nozzle which is suitable for use in performing a first embodiment of the method according to the invention. In the Figure, numeral 12 designates a filling nozzle proper, and 10 nozzle jet tips whose issuing angle has an elevation angle in the range $60°<\theta<90°$ for the previously mentioned reasons. FIG. 10 is a schematic perspective view of another filling nozzle which is suitable for use in performing a second embodiment of the method according to the invention. In the Figure, numeral 13 designates a filling nozzle proper, and 14 a main nozzle whose issuing angle has an elevation angle $\theta$ of $60°<\theta<90°$ for the reasons mentioned previously. Numeral 11 designates an auxiliary nozzle which is made integral with the main nozzle 14 and communicating with the lower part thereof.

Then, in accordance with the present invention the issuing angle $\theta$ of the filling nozzle is selected in the range $60°<\theta<90°$ for the reasons that if the angle $\theta$ is less than 60°, the value of the previously mentioned proportionality constant C becomes insufficient so that the resulting jet of gas fails to reach or come near to the surface of the liquefied gas or the jet of gas directly strikes against the side walls of the storage tank thus failing to expect the desired stirring and mixing effect, and that if the angle $\theta$ is 90° or over, the height of gas jet becomes as low as when the angle $\theta$ is less than 60°.

Thus, the most desirable angle $\theta$ is in the range from 60° to 80°. On the other hand, the auxiliary nozzle 11 is provided for the reason that if the density of the LNG introduced preliminarily into the storage tank is higher than that of the LNG which is introduced later, there is the possibility of the higher density LNG being detained in the tank bottom portion thus causing the formation of strata, and this possibility is prevented by the auxiliary nozzle 11.

What is claimed is:

1. A method for mixing miscible liquefied gases wherein a second liquefied gas different in density from a first liquefied gas contained within a storage tank is injected into said storage tank from the bottom portion thereof, said method comprising: providing an upwardly directed nozzle at the bottom portion of a storage tank near the inner wall thereof; orienting said nozzle to provide a focused jet stream of said second liquefied gas to issue upwardly into said storage tank toward the center of the tank and into said first liquefied gas; and causing said jet stream to reach the free surface of said first liquefied gas in said storage tank, whereby said liquefied gases are mixed together.

2. A method according to claim 1, wherein said second liquefied gas is higher in density than said first liquefied gas.

3. A method according to claim 1, including issuing a secondary jet of relatively small quantity of said second liquefied gas toward an inner bottom area of said storage tank from an auxiliary nozzle arranged at a position lower than the discharge opening of said main nozzle in addition to and simultaneously with said focused jet stream.

4. A method according to claim 1, wherein said second liquefied gas is lower in density than said first liquefied gas.

5. A nozzle apparatus for mixing miscible liquefied gases wherein a second liquefied gas different in density from a first liquefied gas contained within a storage tank is injected into said storage tank from the bottom portion thereof, said apparatus comprising: a storage tank; a nozzle body fixedly arranged at a position in a bottom portion of said storage tank near the inner wall thereof below the surface of said first liquefied gas; means for connecting said nozzle body to a source of a second liquefied gas; and a discharge nozzle opening formed in said nozzle body so as to issue a focused jet stream of said second liquefied gas upwardly into said storage tank and into the first liquefied gas to mix the liquefied gases together.

6. A nozzle apparatus according to claim 5, further comprising an auxiliary discharge nozzle opening formed in said nozzle body at a position lower than said main discharge nozzle opening so as to issue a secondary jet of relatively small quantity of said second liquefied gas toward an inner bottom area of said storage tank in addition to and simultaneously with said focused jet stream.

7. A method according to claim 1 including the step of orienting the axis of injection of said nozzle relative to the horizontal at an angle greater than 60° and less than 90°.

8. An apparatus according to claim 5 wherein the axis of injection of said discharge nozzle is greater than 60° and less than 90°.

* * * * *